US005636714A

United States Patent [19]

Viola

[11] Patent Number: 5,636,714

[45] Date of Patent: Jun. 10, 1997

[54] BI-PARTING ELEVATOR DOOR ACTUATOR APPARATUS

[76] Inventor: Barry J. Viola, R.R. #4, Box 60A, Arkansas City, Kans. 67005

[21] Appl. No.: 358,836

[22] Filed: Dec. 19, 1994

[51] Int. Cl.[6] ..... B66B 13/06

[52] U.S. Cl. ..... 187/324; 187/315; 187/316; 187/334; 187/335; 187/280

[58] Field of Search ..... 187/313, 314, 187/315, 316, 317, 324, 334, 335, 280, 318, 323; 49/26, 28; 192/69.8, 69.62, 69.71

[56] References Cited

U.S. PATENT DOCUMENTS

| | | | |
|---|---|---|---|
| 1,904,009 | 4/1933 | Peelle | 187/335 X |
| 2,484,679 | 10/1949 | Borden | 187/280 |
| 4,149,615 | 4/1979 | Kappenhagen | 187/324 |
| 4,364,454 | 12/1982 | Glaser et al. | 187/314 |

FOREIGN PATENT DOCUMENTS

| | | | |
|---|---|---|---|
| 557978 | 6/1977 | U.S.S.R. | 187/334 X |
| 1030291 | 7/1983 | U.S.S.R. | 187/334 X |
| 9323324 | 11/1993 | WIPO | 187/324 X |

*Primary Examiner*—William E. Terrell
*Assistant Examiner*—Khoi H. Tran
*Attorney, Agent, or Firm*—Phillip A. Rein

[57] ABSTRACT

A bi-parting elevator door actuator apparatus operably connected to a bi-parting door assembly having 1) a door interlock and power control assembly; 2) a bi-fold door actuator assembly; and 3) an electrical control circuit. The door interlock and power control assembly includes 1) a door latch assembly connected to the bi-parting door assembly to hold in a closed position; 2) a cam roller and linkage assembly engagable with the bi-parting door assembly to open and close a first power relay assembly; and 3) a door actuated power assembly having a second power relay assembly operable to be opened on opening of the bi-parting door assembly. An elevator drive motor is denied electrical power when a) the bi-parting door assembly is in an open position; and b) the traveling elevator car assembly reaches a predetermined position for stopping. A bi-fold door actuator assembly is connected to the bi-parting door assembly and having an actuator clutch assembly to prevent damage and recycle when an obstruction is present between closing upper and lower panel assemblies of the bi-parting door assembly. A specially designed roller and roller adjustment assembly is provided to reduce friction and achieve accurate vertical alignment during opening and closing of the bi-parting door assembly.

20 Claims, 9 Drawing Sheets

BI-PARTING ELEVATOR DOOR ACTUATOR APPARATUS

PREFERRED EMBODIMENT OF THE INVENTION

In one preferred embodiment of this invention, a bi-parting elevator door actuator apparatus is provided having 1) a novel safety door actuator assembly including a vertically movable bi-parting door assembly; 2) a door interlock and power control assembly engagable with the bi-parting door assembly to control the opening and closing of vertically movable door members and power to an elevator drive circuit; 3) a bi-fold door actuator assembly to control opening and closing of the bi-parting door assembly and having a clutch system and recycling means; and 4) an electrical control circuit which provides safety interlock features to only allow opening of the bi-parting door assembly when in the proper position for loading and unloading from the elevator car assembly.

The bi-parting door assembly includes an upper panel assembly and a lower panel assembly which are moved vertically relative to each other from opened to closed positions which is primarily known in the prior art. Each upper and lower panel assembly is connected to spaced vertical support members by a guide and roller assembly having spaced adjustable roller members.

The upper and lower panel assemblies have respective lower and upper mating flange members which abut each other in the closed position. The upper and lower mating flange members are respectively connected to a drive chain member of the bi-fold door actuator assembly so that the upper and lower panel assemblies are power driven from closed to opening positions and vice versa.

The lower panel assembly is provided with a trucking bar member connected to the upper mating flange member and being engagable with the door interlock and power control assembly to provide a positive interlock system to prevent opening of the upper and lower panel assemblies except in a certain positive controlled condition as determined through the door interlock and power control assembly.

The door interlock and power control assembly includes 1) a primary support housing assembly including an explosion proof housing and cover assembly having an interlock and linkage housing assembly secured thereto; and 2) a cam actuated interlock and power assembly having a) a cam roller and linkage assembly mounted in the interlock and linkage housing assembly; b) a door latch assembly mounted in the interlock and linkage housing assembly; c) a portion of the door latch assembly engagable with the trucking bar member on the lower panel assembly to hold in a locked condition to be subsequently released therefrom; and d) a first power relay assembly mounted within the explosion proof housing and cover assembly and operable by the cam roller and linkage assembly; and 3) a door actuated power assembly including a door trip arm assembly mounted in the interlock and linkage housing assembly and engagable with a second power relay assembly which is mounted in the explosion proof housing and cover assembly.

The explosion proof housing and cover assembly includes a main housing member having a cover member releasably connected thereto with a gasket therebetween to provide an airtight explosion proof atmosphere therein.

The primary support housing member includes a first switch cavity and a second switch cavity operable to receive therein respective ones of the first power relay assembly and the second power relay having electrical contacts therein.

The electrical contacts are protected in this explosion proof embodiment and are respectively moved from opened and closed positions by the cam roller and linkage assembly and the door trip arm assembly as will be noted.

The cam roller and linkage assembly includes a linkage assembly having one end pivotally connected to the interock and linkage housing assembly and an upper end connected to a roller member which is engagable with a retiring cam member as it approaches a particular floor on which the elevator car assembly is to be stopped for loading and unloading purposes.

The roller member is connected to the first power relay assembly for operation on pivotal movement of the cam roller and linkage assembly to open the electrical contacts therein when the roller member contacts the retiring cam member in order to break electrical current flow through the first power relay assembly to an elevator drive motor.

The door latch assembly includes a door bolt housing member having a door latch or lock bolt member therein which is forced outwardly by a return spring member when the elevator car assembly is passing between floors to secure the bi-parting door assembly in a locked condition. When the roller member is engaged by the retiring cam member, the door bolt member is moved to a retracted position at a predetermined location on a floor where the bi-parting door assembly is to be opened.

Therefore, pivotal movement of the cam roller and linkage assembly operates a dual function being 1) disconnecting of the electrical contacts in the first power relay assembly to cease power to the elevator drive motor; and 2) retraction of the door bolt member so that the bi-parting door assembly can be moved to the open position.

A further electrical safety feature is achieved through the door actuated power assembly having a door trip arm assembly mounted within the interlock and linkage housing assembly and being connected to a second power relay assembly.

The door trip arm assembly is provided with a door trip arm member having an outer portion operable to be engaged with a portion of the trucking bar member of the lower panel assembly when the bi-parting door assembly is in the closed position.

In this closed position, the door trip arm member is pivoted inwardly which operates to rotate a pivot bolt member in one direction with the pivot bolt member being a part of the power relay assembly moving electrical contacts therein to a closed position when the bi-parting door assembly is in a closed position to provide electrical power to the elevator drive motor.

Conversely, the door trip arm member is pivotal in an outward manner when the bi-parting door assembly is moved to the open position which then breaks the electrical contacts in the second power relay assembly so that no power is supplied to the elevator drive motor so that movement of the elevator car assembly cannot occur for obvious safety reasons.

The door interlock and power control assembly achieves features on reaching a proper elevator floor discharge such as 1) the door bolt or latch member is moved inwardly to a disengaged position so that the bi-parting door assembly can be opened by the bi-fold door actuator assembly; 2) the first power relay assembly is moved from its normally closed position to an open position; and 3) on opening of the lower panel assembly, the door trip arm member pivots outwardly to release the closed contacts of the second power relay assembly to prevent power flow therethrough.

The bi-fold door actuator assembly is provided with a pair of door operator assemblies, each mounted on respective upright outer edges of the bi-parting door assembly, and each being electrically operated in a circuit separate from that set forth in the door interlock and power control assembly.

Each door operator assembly includes 1) a main power drive assembly having a drive motor member rotating a power transfer assembly being a chain and sprocket combination; 2) a cycle reset assembly utilizing a cycle transfer assembly having one end driven by the main power drive assembly and an opposite end driving a switch actuator assembly providing a cycle control feature as will be noted; 3) a door actuator assembly having a door actuator sprocket member and a door actuator chain member thereon having outer respective ends connected to respective ones of an upper and lower mating flange member of the upper and lower panel assemblies to cause positive opening and closing of the bi-parting door assembly; and 4) an actuator clutch assembly mounted between the door actuator assembly and the main power drive assembly to cause a safety slippage feature whenever an object might be caught between the upper and lower panel assemblies during a door closing operation.

The actuator clutch assembly is of a friction plate type having a drive clutch plate adjustably and frictionally engagable with a driven clutch plate.

In the operation of the bi-fold door actuator assembly, each door operator assembly operates on energization of each main power drive assembly to concurrently rotate the door actuator assembly for moving the upper and lower panel assemblies to an opened or closed position. Concurrently, the cycle reset assemblies are rotated to achieve de-energization of the main power drive assembly the reaching an opened or closed position of both door operator assemblies.

On having an obstruction between the upper and lower panel assemblies, the main power drive assemblies operate to not further move the closing upper and lower panel assemblies but continue to drive through the cycle reset assembly to rotate a cam switch arm to contact an electrical contact member of the switch actuator assembly to cease operation of the main power drive assembly as a safety feature.

The electrical control circuit includes 1) an elevator drive and control circuit operable to control raising and lowering of the elevator car assembly; and 2) an elevator door circuit to control opening and closing of the upper and lower panel assemblies of the bi-parting door assembly with specific elements thereof to be described in detail.

The elevator drive and control circuit has many conventional safety features plus the added safety feature of the door interlock and power control assembly of the applicant's invention.

OBJECTS OF THE INVENTION

One object of this invention is to provide a bi-parting elevator door actuator apparatus operable with a vertically movable bi-parting door assembly including a door interlock and power control assembly operable 1) to provide a positive mechanical locking feature to prevent opening of the bi-parting door assembly before an elevator car assembly reaches a predetermined position for access to the elevator car assembly; 2) to provide a cam actuator interlock and power assembly operable to be engagable with a retiring cam member on reaching a given floor which is operable to de-energize a first power relay assembly to de-energize an elevator drive motor; and 3) to provide a door actuated power assembly having a door trip arm assembly which is moved to a released position on opening of the bi-parting door assembly and operable to open contacts in a second power relay assembly connected to the electrical drive motor, thus providing a dual safety system so that the elevator car assembly can not be moved when the bi-parting door assembly is moved toward an open position.

Another object of this invention is to provide a bi-parting elevator door actuator apparatus including movable upper and lower panel assemblies driven by a bi-fold door actuator assembly having 1) an actuator clutch assembly utilizing friction drive and driven clutch plates so as to provide a safety feature when an object is caught between the mating upper and lower panel assemblies; and 2) a cycle reset assembly to return the system to the proper operating condition when the obstructing object has been removed.

One other object of this invention is to provide a bi-parting elevator door actuator apparatus including first and second relay assemblies with electrical contacts mounted within an explosion proof housing cover assembly to provide a safety feature wherein a bi-parting door assembly is used in an explosive atmosphere, such as grain elevators and the like.

Another object of this invention is to provide a bi-parting elevator door actuator apparatus including a bi-parting door assembly with vertically movable cooperating upper and lower panel assemblies, each provided with a plurality of spaced guide and roller assemblies having a roller member being adjustably mounted on an eccentric bolt axle member, and each roller member having a track receiving slot therein engagable with a portion of a guide track member to provide for friction reduced movement of the upper and lower panel assemblies from opened to closed positions and vice versa.

One further object of this invention is to provide a bi-parting elevator door actuator assembly which 1) can be easily mounted on existing bi-parting door assemblies; 2) provides a new and novel guide and roller assembly for easy movement of upper and lower panel assemblies of the bi-parting door assembly; 3) provides a bi-fold door actuator assembly to provide positive vertical movement of the upper and lower panel assemblies with an actuator clutch assembly and a cycle reset assembly to protect the upper and lower panel assemblies from damage when an article is placed therebetween and an automatic recycling feature when the obstructing article is removed; 4) includes a door interlock and power control assembly to provide a positive mechanical lock when the upper and lower panel assemblies have been moved to the closed position; and 5) on reaching a desired floor level with the elevator car assembly, the door interlock and power control assembly operates to disengage a first power relay assembly and, on opening of the upper and lower panel assemblies, operates to open electrical contacts in a second power relay assembly to assure that the elevator drive motor of the elevator car assembly has been de-energized so no movement of the elevator car assembly can take place.

Still, one other object of this invention is to provide a bi-parting elevator door actuator apparatus which can be easily mounted on existing bi-parting door assemblies and provides numerous safety features on not permitting the energization of the elevator drive motor of the elevator assembly when a bi-parting door assembly is moved toward an open position; provides a mechanical interlock system to prevent opening of the bi-parting door assembly when the elevator drive motor of the elevator car assembly is energized; is sturdy in construction; economical to manufacture; and substantially maintenance free.

Various other objects, advantages, and features of the invention will become apparent to those skilled in the art from the following discussion, taken in conjunction with the accompanying drawings, in which:

FIGURES OF THE INVENTION

Figure 14:
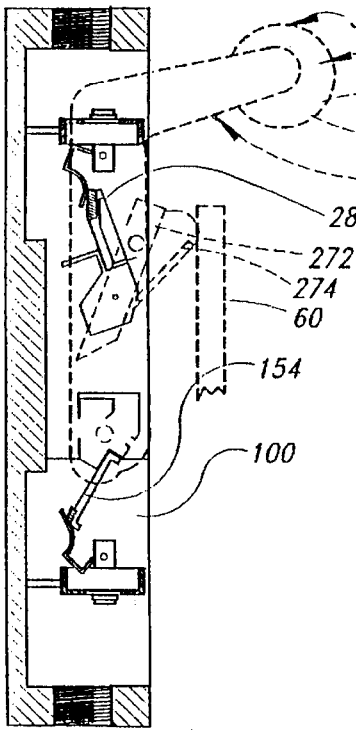
Figure 15:
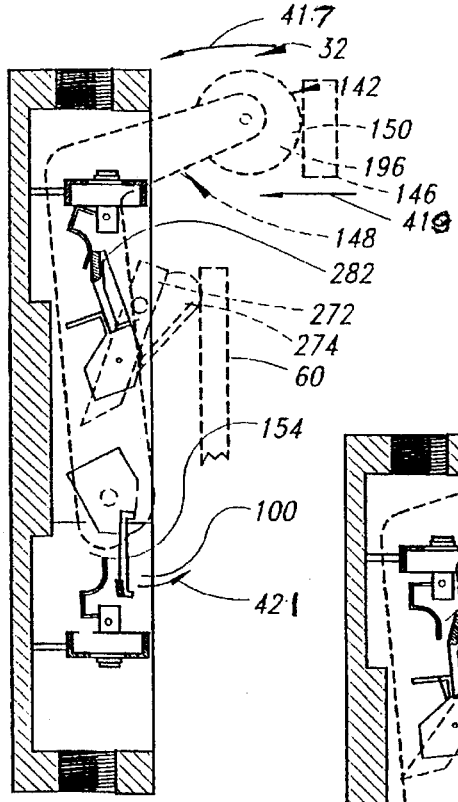
Figure 16:
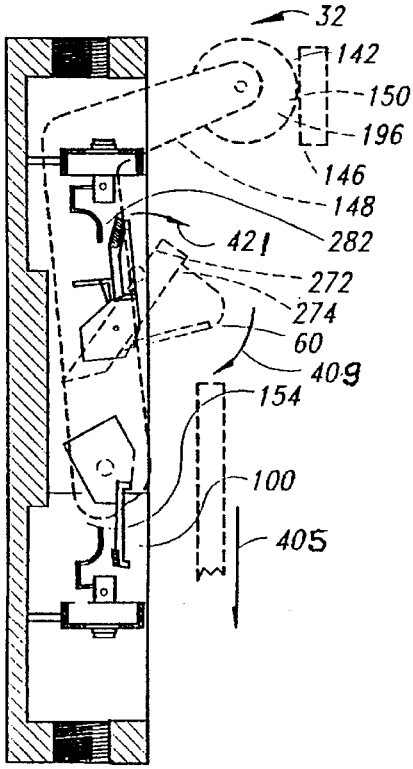
Figure 17:
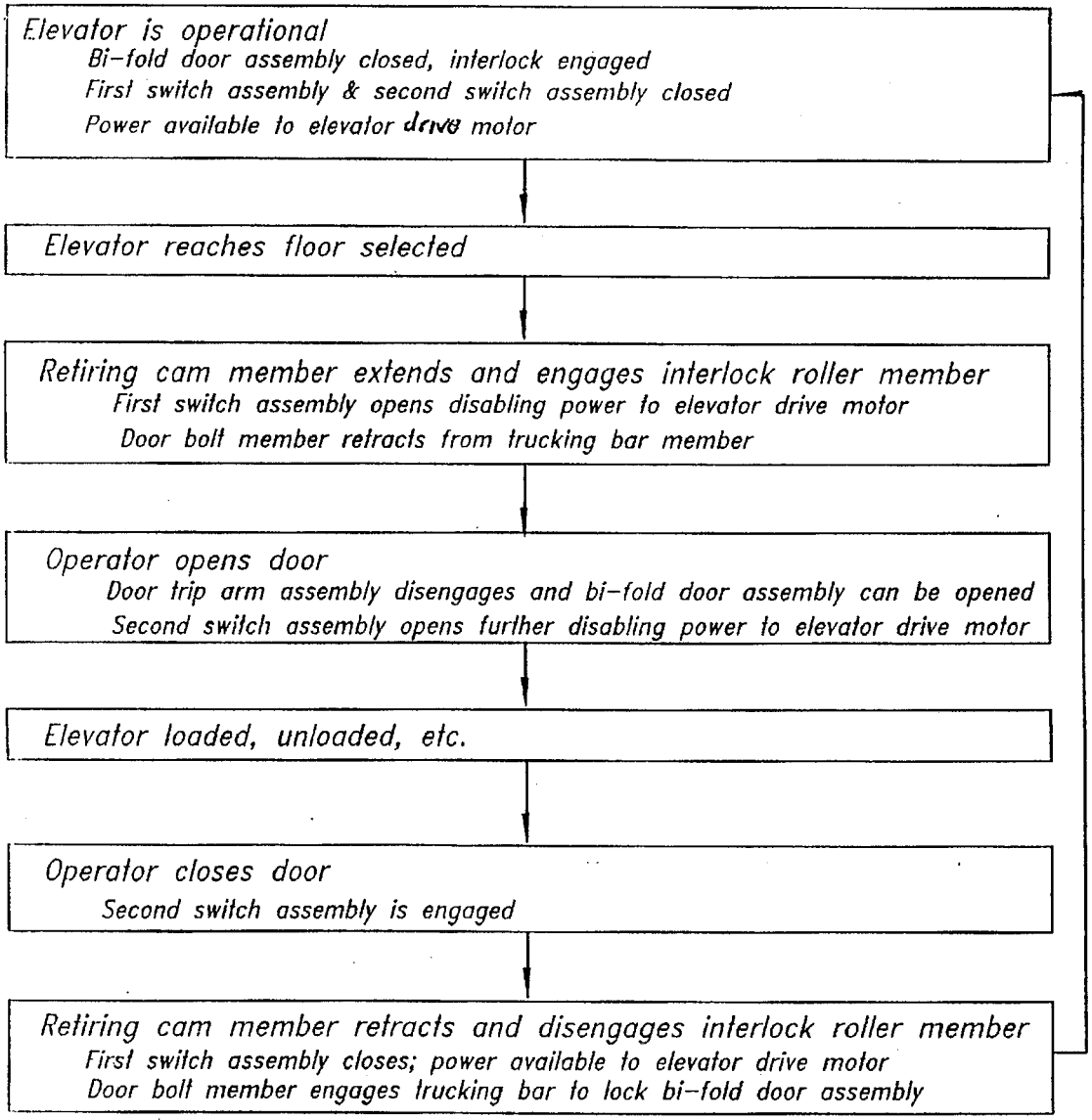

FIGS. 14, 15, and 16 are schematic view illustrating operation of a door interlock and power control assembly of the bi-parting elevator door actuator apparatus of this invention; and FIG. 17 is a schematic diagram of sequential steps during operation of the bi-parting elevator actuator apparatus of this invention.

The following is a discussion and description of preferred specific embodiments of the bi-folding elevator door actuator apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 1:
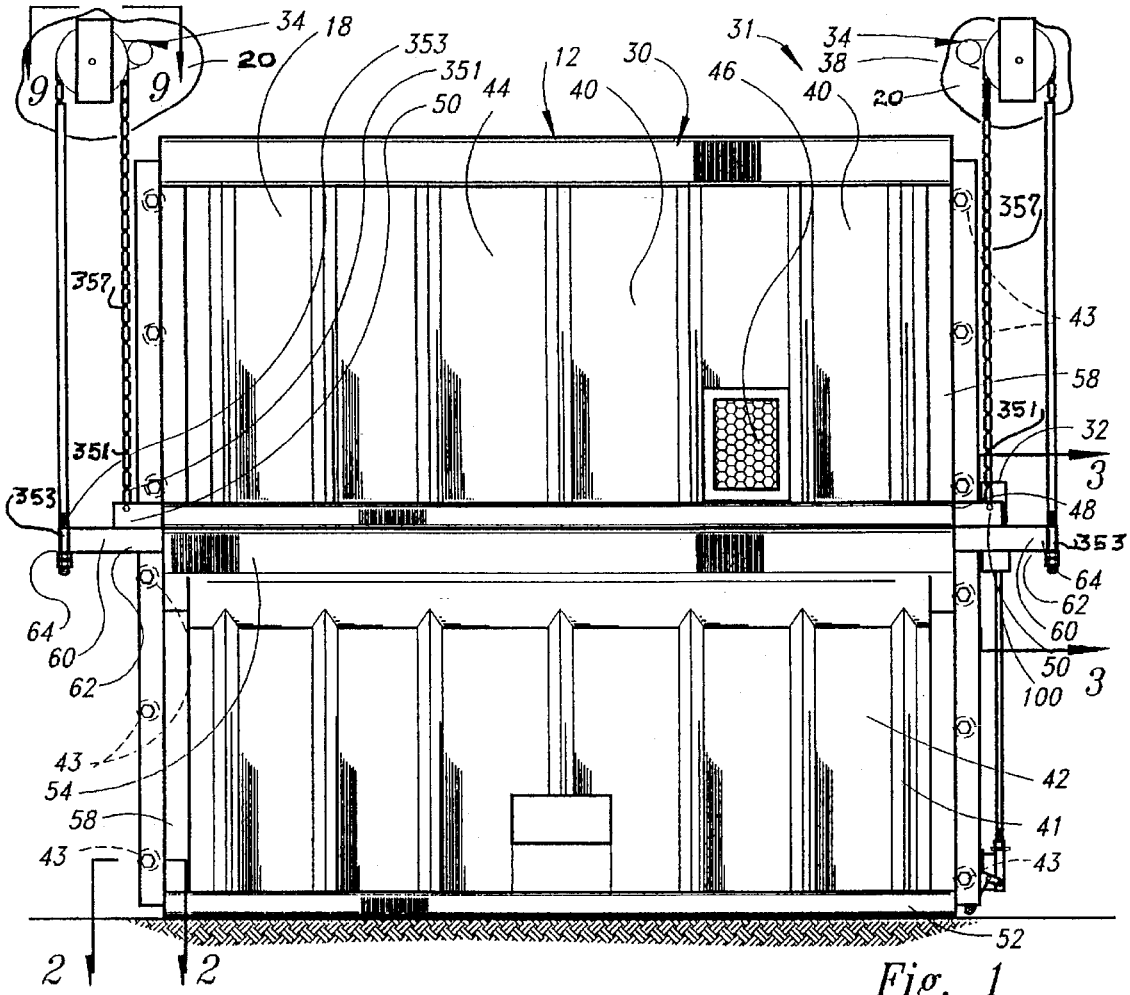
FIG. 1 is a front elevational view of a bi-parting door assembly having the bi-parting elevator door actuator apparatus of this invention connected thereto.

On referring to the drawings in detail, and in particular to FIG. 1, a main movable elevator car assembly 14 is illustrated as being adjacent a bi-parting elevator door actuator apparatus of this invention, indicated generally at 12.

The main movable elevator car assembly 14 is provided with a support platform 16 to receive persons, cargo, and the like thereon for vertical movement in an elevator shaft such as found in a grain warehouse, freight storage warehouse, and the like. A main elevator drive motor is operable to move the main movable elevator car assembly 14 between various vertically stacked floor openings in an elevator shaft in a conventional manner.

The bi-parting door actuator apparatus 12 includes 1) a bi-parting door assembly 30 operable to open and close in a generally conventional manner but having important features added thereto; 2) a door interlock and power control assembly 32 operably engagable with a portion of the bi-parting door assembly 30; 3) a bi-fold door actuator assembly 31 connected to a stationary wall section side 20 and the bi-parting door assembly 30 to open close in a unique manner; and 4) all electrical control circuit 33 to control operation of the main movable elevator car assembly 14 and the door interlock and power control assembly 32.

The bi-parting door assembly 30 includes an upper panel assembly 40 cooperating with a lower panel assembly 42 to expose and enclose an entrance opening into the main movable elevator car assembly 14. The upper and lower panel assemblies 40, 42 are each provided with a plurality, namely six, of guide and roller assemblies 43 connected to outer support members as will be noted.

The upper panel assembly 40 includes a main body support member 44 composed of separate interconnected panel members 41. The main body support member 44 includes 1) vertical support plate members 58 positioned at each outer end thereof; 2) a window member 46 for use by an elevator operator; and 3) a lower mating flange member 48 operable to engage a like structure on the lower panel assembly 42 in the closed position.

Each outer end of the lower mating flange member 48 is provided with an anchor portion 50 used for raising and lowering of the upper and lower panel assemblies 40, 42 in a manner to be described.

Figure 2:
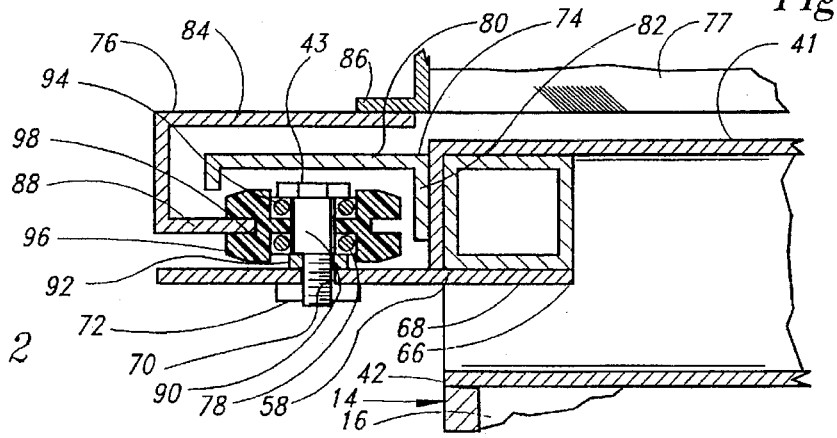
FIG. 2 is an enlarged fragmentary sectional view taken along line 2—2 in FIG. 1.

As noted in FIG. 2, each guide and roller assembly 43 includes 1) a roller support flange member 66 secured to a respective one of the vertical support members 58; 2) a roller assembly cover member 74 secured adjacent a portion of the vertical support members 58 to act as a shield; 3) a guide track member 76 secured to a stationary portion of a door frame 77; and 4) a guide roller assembly 78 connected to the roller support flange member 66 and operably engagable with the guide track member 76.

The roller support flange member 66 includes a body portion 68 of rectangular plate construction having an anchor hole 70 therein for mounting of the guide roller assembly 78 therein.

The roller assembly cover member 74 is of generally U-shape in transverse cross section including a support body section 80 having an anchor connector section 82 which is secured to an adjacent panel member 41 and the vertical support member 58.

As noted in FIG. 2, the guide track member 76 is of generally J-shape in transverse cross section having a support portion or leg 84 secured to a stationary anchor portion 86 and having an outer guide portion 88 extended parallel to the support portion or leg 84. An outer end of the guide portion 88 is operable to be engagable with the respective guide roller assembly 78 as will be noted.

Each guide roller assembly 78 includes 1) an eccentric bolt axle or shaft member 90; 2) a sealed bearing member 94 having a roller member 96 mounted thereon, both mounted about the eccentric axle member 90; 3) a spacer or washer member 92 mounted about the eccentric axle member 90 and placed against an inner surface of the roller support flange member 66 and about the anchor hole 70; and 4) an anchor nut member 72 is mounted on the threaded outer end of the eccentric axle member 90 which is extended through the anchor hole 70 to achieve the assembled condition of FIG. 2.

In this assembled condition, it is noted that the roller member 96 has a peripheral track receiver slot 98 which is adapted to receive the outer end of the guide portion 88 of the guide track member 76 therein. This achieves proper aligned movement with little friction due to the sealed bearing member 94 when the upper and lower panel assemblies 40, 42 are moved to the opened and closed positions.

The eccentric axle member 90 is operable in a conventional manner to be rotated which can selectively vary the distance between the track receiver slot 98 and the outer end of the guide portion 88 of the guide track member 76. This achieves an infinitely adjustable feature to make the guide and roller assembly 43 unique in operation in this environment.

As noted in FIG. 1, three of the spaced guide and roller assemblies 43 are mounted along each of the four respective vertical support members 58 of the upper and lower panel assemblies 40, 42. This achieves reduced friction vertical movement of the upper and lower panel assemblies 40, 42 when moved from the opened to the closed positions and vice versa. As noted in FIG. 1, there has been a total of twelve of the guide and roller assemblies 43 utilized.

The lower panel assembly 42 includes a main body support or panel member 52 having an upper mating flange member 54 which is operable to engage the lower mating flange member 48 in the upper panel assembly 40 when in the closed position of FIG. 1.

The main body panel member 52 is provided with a vertical support member 58 along outer vertical edges thereof similar to the construction of the main body support member 44 of the upper panel assembly 40.

The upper mating flange member 54 is provided at each opposite end with a trucking bar member 60. Each trucking bar member 60 is provided with a support body section 62 with an outer anchor portion 64 which is operable to be connected to a portion of the bi-fold door actuator assembly 31.

A central portion of the support body section 62, as shown on the right hand side of the view in FIG. 1, is operable to engage the door interlock and power control assembly 32 in a manner to be explained.

Figures 5, 6:
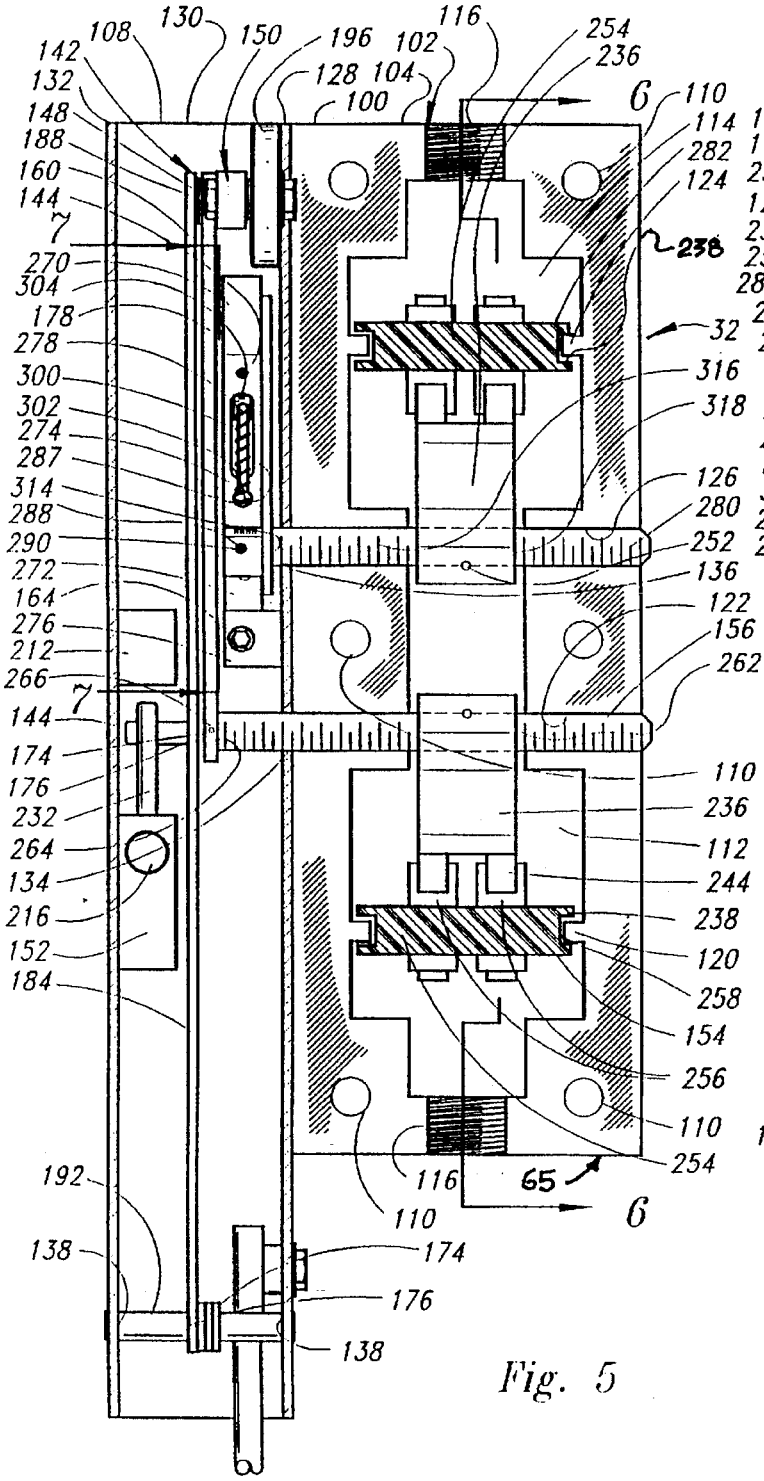
FIG. 5 is a view taken along line 5—5 in FIG. 3.
FIG. 6 is a sectional view taken along line 6—6 in FIG. 5.

As noted in FIG. 5, the door interlock and power control assembly 32 includes 1) a primary support housing assembly 65; 2) a cam actuated interlock and power assembly 102 mounted within the primary support housing assembly 65; and 3) a door actuated power assembly 144 mounted within the primary support housing assembly 65.

The primary support housing assembly 65 includes an explosion proof housing and cover assembly 100 having an interlock and linkage housing assembly 108 connected to an outer side wall of the explosion proof housing and cover assembly 100.

As shown in FIG. 6, the explosion proof housing and cover assembly 100 includes a main housing member 104 of generally rectangular block shape having a cover member 106 releasably connected thereto as by fasteners or bolt members and having a sealing gasket 105 mounted therebetween.

The cover member 106 and gasket member 105 operate with the bolt members to provide an airtight seal within a central portion of the main housing member 104 so as to maintain the area therein in an explosion proof atmosphere which is necessary due to electrical relay contact members therein as will be explained.

The main housing member 104 is provided with 1) a plurality, namely six, fastener holes 110 to receive the bolt members for attaching the cover member 106 thereto; 2) a first switch cavity 112; 3) a second switch cavity 114 integral with the first switch cavity 112; 4) electrical conduit anchor openings 116 integral with respective ones of the first and second switch cavities 112, 114; and 5) a pair of spaced inclined switch spring retainer members 118 (FIG. 6) to support a compression spring member thereon.

The first switch cavity 112 is provided with a pair of axially aligned spaced switch anchor members or lugs 120 and aligned first pivot bolt holes 122 for reasons to be explained.

The second switch cavity 114 is provided with a pair of opposed aligned switch anchor members or lugs 124 and alighted second pivot bolt holes 126 for reasons to be explained.

The interlock and linkage housing assembly 108 is of generally U-shape in transverse cross section including a first side wall section 128 integral with a support body section 130 which, in turn, is integral with a second side wall section 132. The first side wall section 128 has spaced holes therein and is secured as by threaded bolt members in a conventional manner to the adjacent outer side wall of the main housing member 104.

The first side wall section 128 is provided with a first pivot bolt opening or slot 134 and a second pivot bolt opening or slot 136. Further, the first and second side wall sections 128, 132 are provided with aligned spaced anchor holes 138 for pivotal connection to a portion of the cam actuated interlock and power assembly 102 in a manner to be described.

The second side wall section 132 is provided with the identical first and second pivot bolt openings 134, 136, pivot opening 138, and the numerous holes for attachment of the cam actuated interlock and power assembly 102. This allows the interlock and linkage housing assembly 108 to be mounted to selected, opposed parallel side wall portions of the explosion proof housing and cover assembly 100. The door interlock and power control assembly 32 can be mounted on left or right sides of the bi-parting door assembly 30 as desired.

The cam actuated interlock and power assembly 102 includes 1) a cam roller and linkage assembly 142 mounted within the interlock and linkage housing assembly 108; 2) a door latch assembly 152 mounted within the interlock and linkage housing assembly 108 and engagable with the cam roller and linkage assembly 142; and 3) a first power relay assembly 154 mounted within the explosion proof housing and cover assembly 100 and operably connected to the cam roller and linkage assembly 142.

The cam roller and linkage assembly 142 includes 1) a retiring cam member 146 which is a movable element connected to the elevator car assembly 14; 2) a linkage assembly 148 which is pivotally connected to a portion of the interlock and linkage housing assembly 108 and operably connected to the first power relay assembly 154; and 3) a roller and roller adjustment assembly 150 connected to the linkage assembly 148.

The linkage assembly 148 includes a roller arm member 158 having one end pivotally connected to the first and second side wall sections 128, 132 of the interlock and linkage housing assembly 108 and an opposite upper end thereof is pivotally connected to a cam support arm member 160.

The roller arm member 158 includes a cam arm attachment section 162 which is integral with a main body section 178 which, in turn, is integral with a bolt end section 164. The cam arm attachment section 162 is provided with a linkage pivot hole 166 and an adjustment lobe section 168 having a fastener hole 170 therein.

On referring to FIG. 5, the bolt end section 164 is provided with a bolt opening 172, a roll pin hole 174, and a roll pin member 176 mounted through the roll pin hole 174 and aligned pivot openings 138 in the first and second side wall sections 128, 132 of the linkage housing member 108 to provide a pivot access to the roller arm member 158.

The cam arm member 160 includes a pivot arm section 180 integral with a body support section 184 which, in turn, is integral with an anchor and pivot end section 182.

The pivot arm section 180 is provided with a pivot linkage hole 186 adapted to receive a linkage pin member 188 therein for pivotal connection and mounted through the linkage pivot hole 166 in the cam arm attachment section 162 of the roller arm member 158.

The anchor and pivot end section 182 is provided with 1) an anchor pivot opening 190; 2) a roll pin opening 174 to receive a roll pivot member 176; and 3) a housing pivot pin member 192 mounted in the anchor pivot opening 190 and the aligned pivot arm opening 138 in the interlock and linkage housing assembly 108.

The central body support section 184 is provided with a laterally extended throw bolt actuator member 194 for reasons to be explained.

The roller and roller adjustment assembly 150 includes a roller member 196 connected to a roller support member 198 which is adjustably connected to the cam arm attachment section 162 of the roller arm member 158.

The roller member 196 has a central roller pivot opening 200 which receives a roller pivot fastener 202 therein for pivotal connection to an outer end of the cam arm attachment section 162.

The roller support member 198 is provided with an adjustment lobe portion 204 having a central cam fastener slot 206 therein and is provided with an outer pivot roller opening 210 to receive the roller pivot fastener 202 therethrough.

A cam fastener member 208 is placed within the threaded fastener hole 170 and allows for adjustable axial movement of the roller support member 198 to adjust contact with the retiring cam member 146 as will be noted.

The door latch assembly 152 includes 1) a stop block member 212 connected to the second side wall section 132 of the interlock and linkage housing assembly 108; 2) a door bolt housing 214 similarly attached to the second side wall section 132 of the interlock and linkage housing assembly 108; 3) a door bolt member 216 reciprocally mounted within the door bolt housing 214; and 4) a return spring member 218 mounted against the support body section 130 and engagable with the door bolt member 216 to bias toward an interlocked condition.

Figure 3:
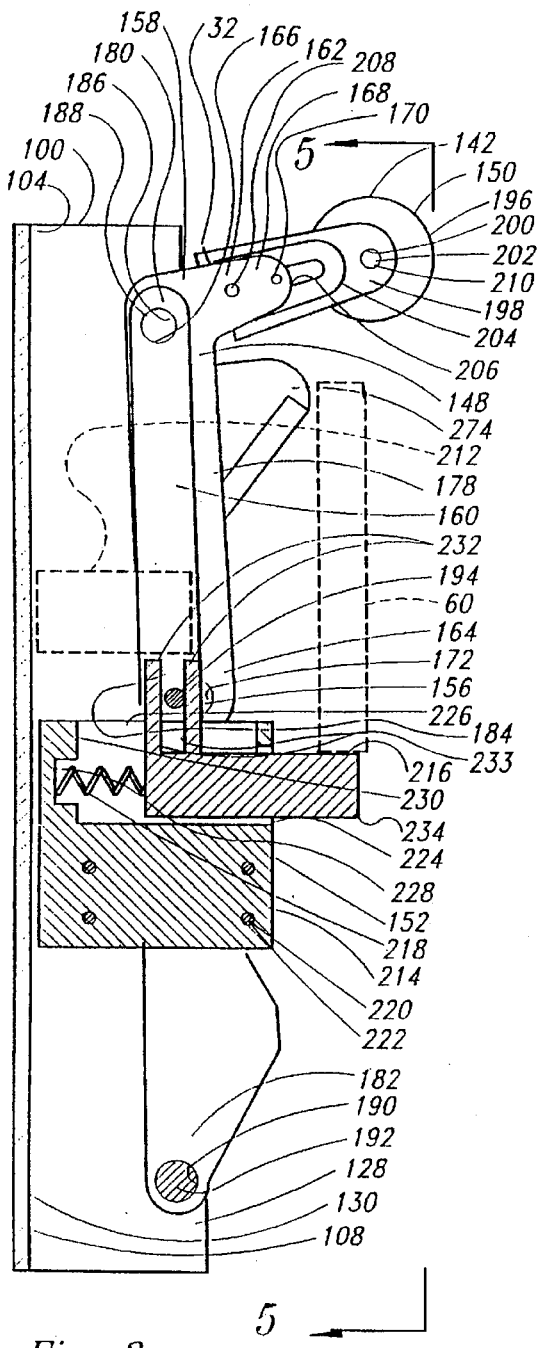
FIG. 3 is an enlarged fragmentary sectional view taken along line 3—3 in FIG. 1.
Figure 4:
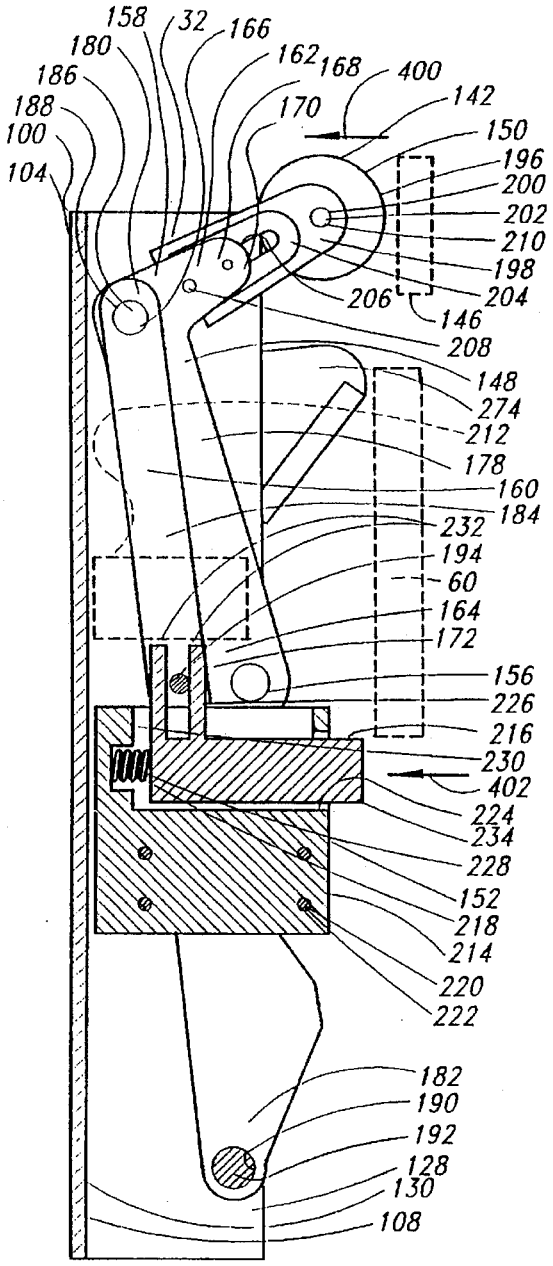
FIG. 4 is a view similar to FIG. 3 illustrating movement of a cam actuated interlock and power assembly during contact with a retiring cam member.

As shown in FIG. 3, the door bolt housing 214 is provided with 1) a plurality namely four, of spaced anchor holes 220, each to receive an anchor member 222 therein for attachment to the second side wall section 132; 2) a door bolt guide opening 224 to receive the door bolt member 216 therein; and 3) a spring recess 228 to receive and guide the return spring member 218 therein and operable to receive a portion of the door bolt member 216 thereagainst in a retracted position (FIG. 4).

The door bolt member 216 is of a cylindrical shape having an inner portion thereof connected to laterally extended actuator pin members 232 and an outer trucking bar contact surface 234. Each actuator pin member 232 is provided with a facing contact surface 233 operable to engage the throw bolt actuator member 194 during movement thereof.

The outer one of the outer actuator pin members 232 is operable to engage a portion of the door bolt housing 214 to limit outward movement thereof to the fully extended position as shown in FIG. 3.

On referring to FIG. 5, the first power relay assembly 154 includes 1) a pivot contact member 236; 2) a stationary contact member 238; 3) a first pivot bolt member 156 which is connected to the pivot contact member 236 and pivotally mounted in the first pivot bolt hole 122 in the first switch cavity 112 of the main housing member 104; and 4) the first pivot bolt member 156 is attached to the anchor and pivot end section 182 of the cam support arm member 160 of the cam roller and linkage assembly 142.

As noted in FIG. 6, the pivot contact member 236 is provided with 1) a return spring opening 240 having a return spring member 242 therein mounted on the switch spring retainer member or lug 118; 2) a contact arm member 244 operable to engage the stationary contact member 238; and 3) a first pivot bolt opening 246 operable to receive a portion of the first pivot bolt member 156 therethrough.

The contact arm member 244 is provided with an outer contact surface 248 which is engagable with the stationary contact member 238 to transfer electrical current therebetween.

The first pivot bolt opening 246 has a retainer pin opening 250 having a retainer pin member 252 mounted therethrough to assure that the pivot contact member 236 pivots with rotational movement of the first pivot bolt member 156.

The stationary contact member 238 is provided with a housing member 254 having a pair of flexible contact members 256 pivotally connected and biased by a bias spring member 257.

The housing member 254 is provided with outer opposed mounting slots 258 which are adapted to be supported on the switch anchor members or lugs 120 in the first switch cavity 112 of the main housing member 104 as noted in FIG. 5.

The movable contact members 256 are pivotally connected to the housing member 254 to limit outward movement in one direction but allow pivotal movement in an opposite direction against the respective bias spring members 257.

On referring to FIG. 5, the door actuated power assembly 144 includes a door trip arm assembly 270 mounted within the interlock and linkage housing assembly 108 and operably connected to a second power relay assembly 282 which is mounted within the second switch cavity 114 in the main housing member 104 of the explosion proof housing and cover assembly 100.

Figure 7:
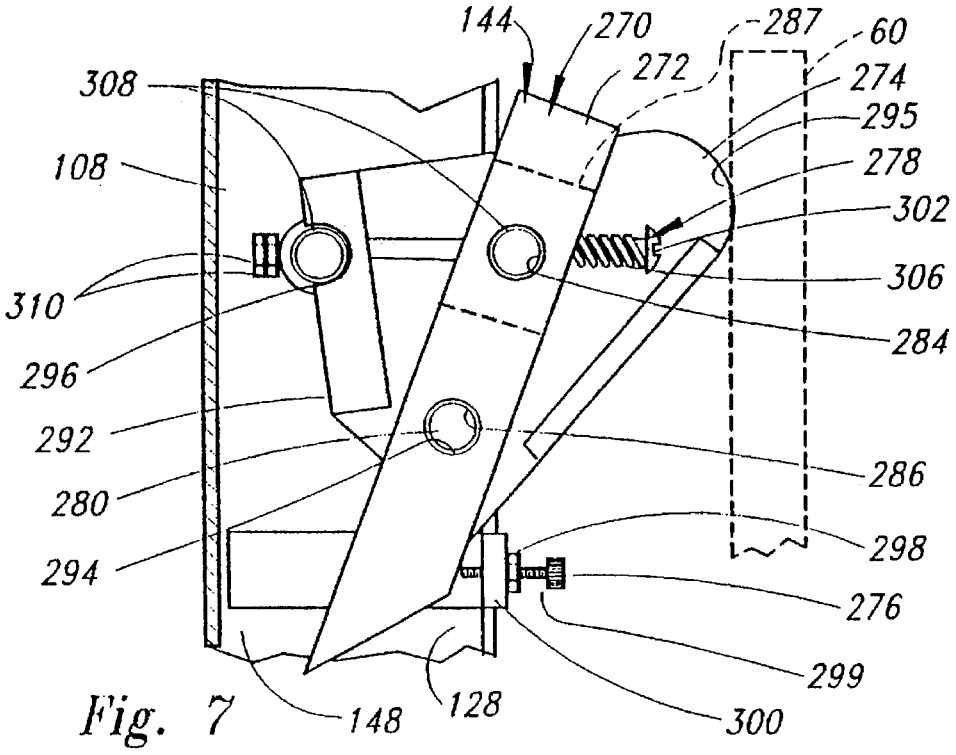
FIG. 7 is an enlarged fragmentary sectional view taken along line 7—7 in FIG. 5.

As shown in FIG. 7, the door trip arm assembly 270 includes 1) a relay actuator arm member 272 pivotally connected to a portion of the second power relay assembly 282; 2) a door trip arm member 274 pivotally connected to a portion of the common element of the second power relay assembly 282; 3) a travel adjustment assembly 276 connected to a first side wall section 128 of the interlock and linkage housing assembly 108 engagable with a portion of the relay actuator arm member 272; and 4) a bias linkage assembly 278 collectively connected to the door trip arm member 274 and the relay actuator arm member 272.

The relay actuator arm member 272 is of a rectangular block shape having an anchor lug opening 284, a second pivot bolt opening 286, and an access slot 287 therein.

The second pivot bolt opening 286 is provided with a retainer pin opening 290 having a retainer pin member 288 to provide a locking feature with a portion of the second power relay assembly 282 as will be noted.

The door trip arm member 274 is of an irregular shape having a wear linkage flange section 292 engagable with the relay actuator arm member 272, a pivot bolt opening 294, an anchor lug opening 296, and a door contact flange 295 operable to contact the trucking bar member 60 of the lower panel assembly 42 during operation as will be explained.

The bias linkage assembly 278 includes a bolt member 302 mounted through the access slot 287 in the relay actuator arm member 272 and having a spring member 306 mounted about the bolt member 302 and extended through pivotal anchor lug members 308. A lock nut member 310 is mounted on an outer end of the threaded bolt member 302 operable to adjust bias force from the spring member 306.

Each pivotal anchor lug member 308 is of cylindrical shape and being placed within the respective pivot bolt holes 284, 296 in the relay actuator arm member 272 and the wear linkage flange section 292 of the door trip arm member 274.

The bolt member 302 is extended through aligned openings in the pivotal anchor lug members 308 to allow movement therein.

The second power relay assembly 282 is mounted within the second switch cavity 114 in the main housing member 104 of the explosion proof housing and cover assembly 100.

The second power relay assembly 282 is substantially identical to the first power relay assembly 154 and detailed discussion is not deemed necessary. The second power relay assembly 282 includes 1) the pivot contact member 236; 2) the stationary contact member 238 secured to switch anchor members or lugs 124 in the second switch cavity 114; and 3) a second pivot bolt member 280 connected to the pivot contact member 236 and to the door trip arm assembly 270.

The pivot contact member 236 includes 1) the contact arm member 244 operable to engage the stationary contact member 238; and 2) a second pivot bolt opening 330 to receive the second pivot bolt member 280 therethrough.

The contact arm member 244 is provided with the outer contact surface 248 engagable with the stationary contact member 238.

The second pivot bolt opening 286 has a retainer pin opening 250 to receive a retainer pin member 252 to lock onto the second pivot bolt member 280 for conjoint rotation therewith.

The stationary contact member 238 includes the housing member 254 rigidly mounted in the second switch cavity 114 and having a flexible contact member 256 pivotally connected to the housing member 254 and having a bias spring member 257 engagable with each of the flexible contact members 256.

The housing member 254 is provided with opposed mounting slots 258 engagable in a locked condition with the switch spring retainer members 118 in the second switch cavity 114.

The flexible contact members 256 are biased outwardly by the bias spring members 257 but are limited in outward movement by its connection to the housing member 254.

Figure 9:
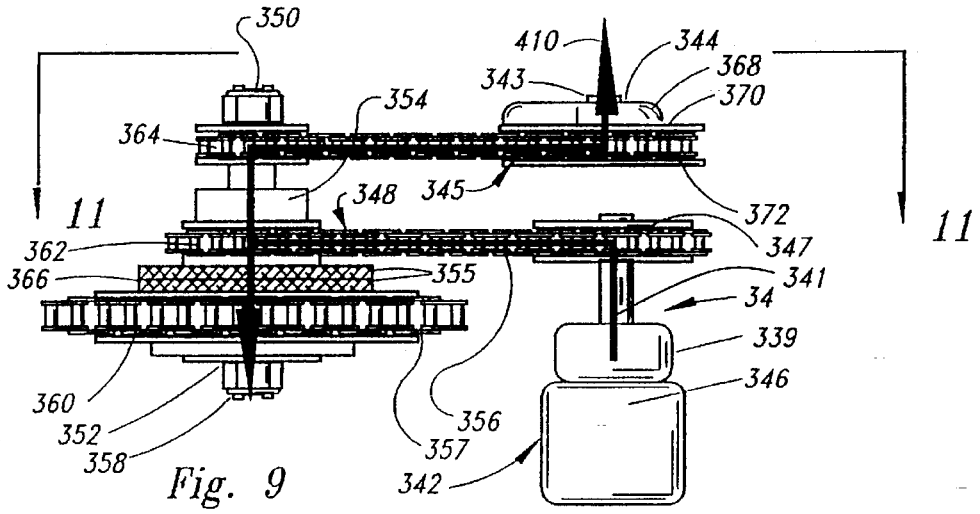
FIG. 9 is an enlarged sectional view taken along line 9—9 in FIG. 1.
Figure 10:
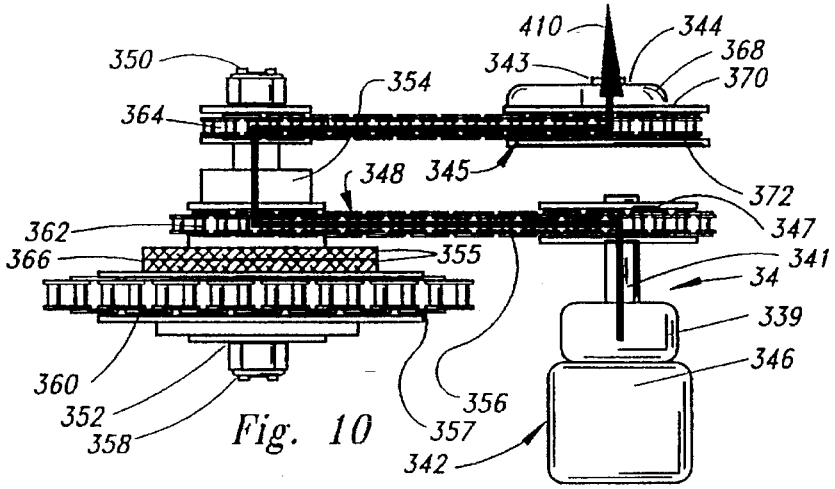
FIG. 10 is a view similar to FIG. 9 illustrating a different operational feature of a bi-fold door actuator assembly.
Figure 11:
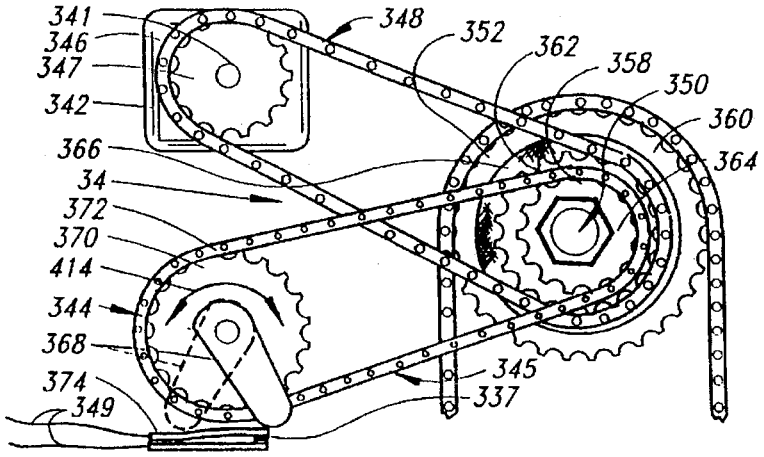
FIG. 11 is a fragmentary elevational view taken along line 11—11 in FIG. 9.

As collectively shown in FIGS. 9, 10, and 11, the bi-fold door actuator assembly 31 is provided with a pair of door operator assemblies 34 with one each mounted on opposed adjacent side wall sections 20 of the hi-parting door assembly 30 as noted in FIG. 1.

Each door operator assembly 34 includes 1) a main power drive assembly 342; 2) a cycle reset assembly 344 operably connected to the main power drive assembly 342; 3) a door actuator assembly 352 connected to portions of the upper panel assembly 40 and the lower panel assembly 42 for opening and closing thereof; and 4) an actuator clutch assembly 366 mounted between the door actuator assembly 352 and the main power drive assembly 342 to provide a new and novel clutch system to prevent damage to the upper and lower panel assemblies 40, 42 when an object is placed therebetween during a door closing function.

The main power drive assembly 342 includes a drive motor member 346 connected to a power transfer assembly 348. The drive motor member 346 is preferably connected through a reduction gear box 339 to power an output drive shaft 341.

The power transfer assembly 348 includes 1) a drive chain member 356 trained at one end about a drive sprocket assembly 347 anchored to the drive shaft 341; 2) a driven sprocket member 362 connected to an opposite outer end of the drive chain member 356; and 3) a driven support coupling 354 connected to the driven sprocket member 362 which, in turn, is connected to a driven shaft member 350.

The cycle reset assembly 344 includes a cycle transfer assembly 345 and having a switch actuator assembly 347 connected to a portion thereof.

The cycle transfer assembly 345 includes 1) a cycle support sprocket member 364 which is connected to the driven shaft member 350; 2) a cycle chain member 372 trained about the cycle support sprocket member 364; and 3) a switch actuator sprocket member 370 connected about another outer portion of the cycle chain member 372.

As noted in FIG. 11, the cycle reset assembly 344 includes a cam switch arm 368 which is connected to a driven shaft 343 so as to rotate therewith and engagable with an electrical contact member 374. The adjustable cam switch arm 368 is movable conjointly with rotation of the driven shaft 343 to open or close the contact points 337 which are connected to electrical wire members 349 to open and close a relay to cease power to the main elevator drive motor 388 in a manner to be explained.

The door actuator assembly 352 includes a door actuator sprocket member 360 having a door actuator chain member 357 mounted thereon and the door actuator sprocket member 360 is connected to a support shaft member 358.

As noted in FIG. 1, the door actuator chain member 357 is provided with 1) an anchor end section 351 connected to both anchor portions 50 of the upper panel assembly 40 for raising of the upper panel assembly 40 and conjointly lowering the lower panel assembly 42; and 2) an adjustable end section 353 is connected to a pair of trucking bar members 60 of the lower panel assembly 42 for raising the lower panel assembly 42 and conjointly lowering the upper panel assembly 40 from an opened position to the closed position as shown in FIG. 1.

The actuator clutch assembly 366 includes a friction clutch plate 355 connected to the driven shaft member 350 and a friction clutch plate 355 connected to the support shaft member 358 and the jointly rotatable door actuator sprocket member 360.

The actuator clutch assembly 366 is provided with the abutting friction disk type clutch plates 355 with pressure therebetween being adjustable for a safe and controlled operation of the door operator assemblies 34.

Figure 12:
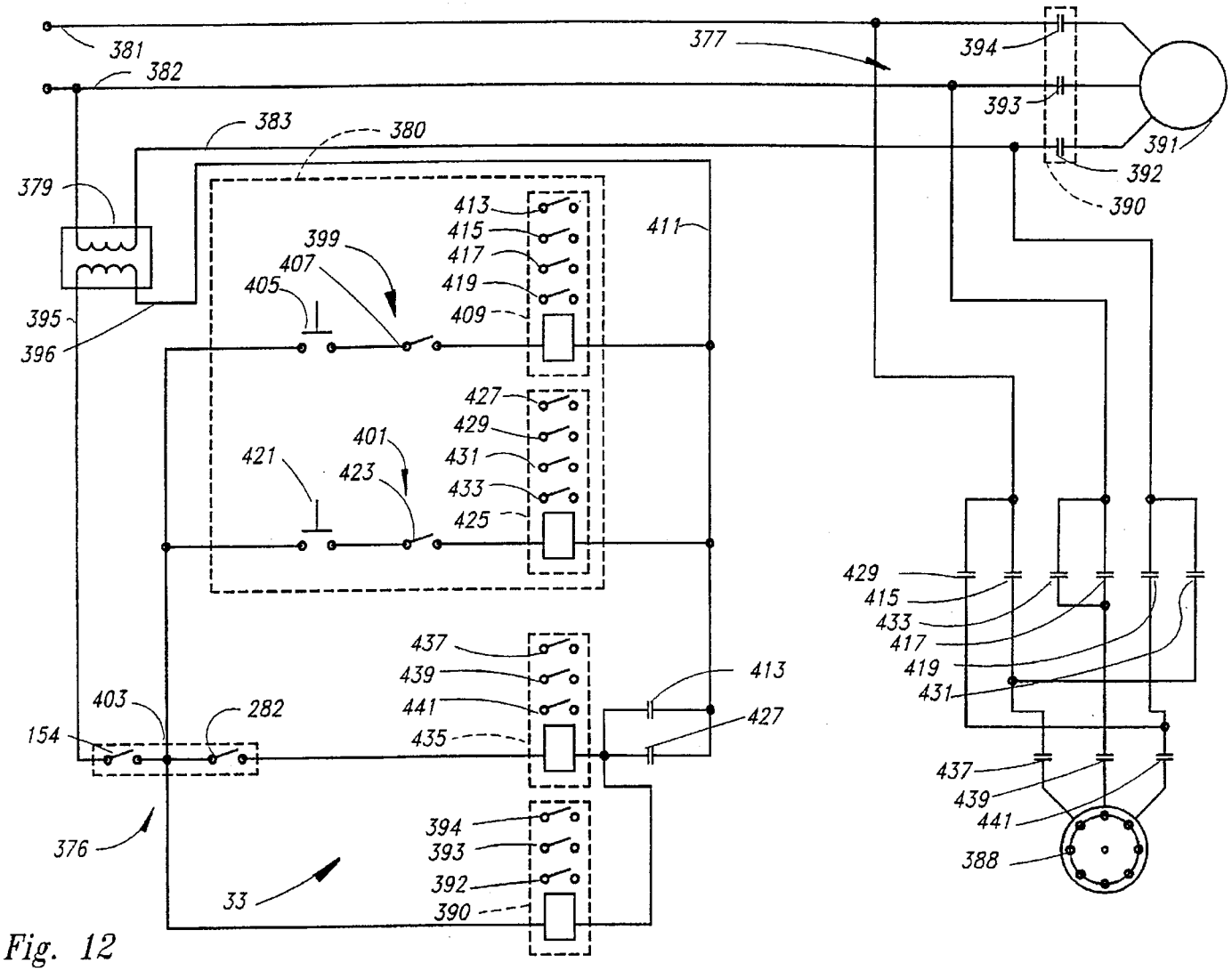
FIG. 12 is an electrical schematic of an elevator drive and control circuit of this invention.

The electrical control circuit 33 includes 1) an elevator drive and control circuit 376 as shown in FIG. 12 operable to raise and lower the entire elevator car assembly 14; and 2) an elevator door circuit 378 operable to control the door operator assemblies 34 and to energize the drive motor members 346.

As shown in FIG. 12, the elevator drive and control circuit 376 includes an elevator power drive circuit 377 having power inlet lines 381, 382, 383 operable to provide a three phase, 480 volt power supply. This power supply is directed through an elevator power drive circuit 377 connected to a retiring cam relay 390 through retiring relay contact levers 392, 393, 394 to power a retiring cam motor 391.

The retiring cam motor 391 is operable to extend the retiring cam member 146 mounted on a moving elevator car assembly 14 so that it will only engage the roller member 196 of the roller and roller adjustment assembly 150 when reaching a selected floor on which the elevator car assembly 14 is to be stopped.

Connected to the power inlet lines 382 and 383 is a transformer member 379 to provide a 110 volt single phase power supply to transform outlet lines 395 and 396.

The outlet line 395 from the transformer member 379 is then trained through the first power relay assembly 154 and the second power relay assembly 282 of the door interlock and power control assembly 32 which are connected in a series and connected by an inlet line 403 to an elevator control circuit 380.

The elevator control circuit 380 is connected by the inlet line 403 to an up switch assembly 399 and a down switch assembly 401 to control energization of an elevator drive motor 388 and cause selective reverse operation thereof.

The up switch assembly 399 includes an up button 405 connected to a top limit switch 407 which, in turn, is connected to an up motor starter relay 409. A ground line 411 completes an electrical circuit to the up motor starter relay 409.

The up motor starter relay 409 includes up contact levers 413, 415, 417, and 419 that, when closed, will complete the circuit to the elevator drive motor 388 in conjunction with closure of a safety backup relay 435 and its backup contact levers 437, 439, and 441 as indicated in FIG. 12.

The down switch assembly 401 includes a down button 421 connected to a bottom limit switch 423 which, in turn, is connected to a down motor starter relay 425. The ground line 411 completes an electrical circuit to the down motor starter relay 425.

The down motor starter relay 425 includes down contact levers 427, 429, 431, and 433 that, when closed, will complete the circuit to the elevator drive motor 388 in conjunction with closure of the safety backup relay 435.

It is noted that the retiring cam relay 390 is energized by the inlet line 403 and the ground line 411 on closure of the up contact lever 413 or the down contact lever 427.

Figure 13:
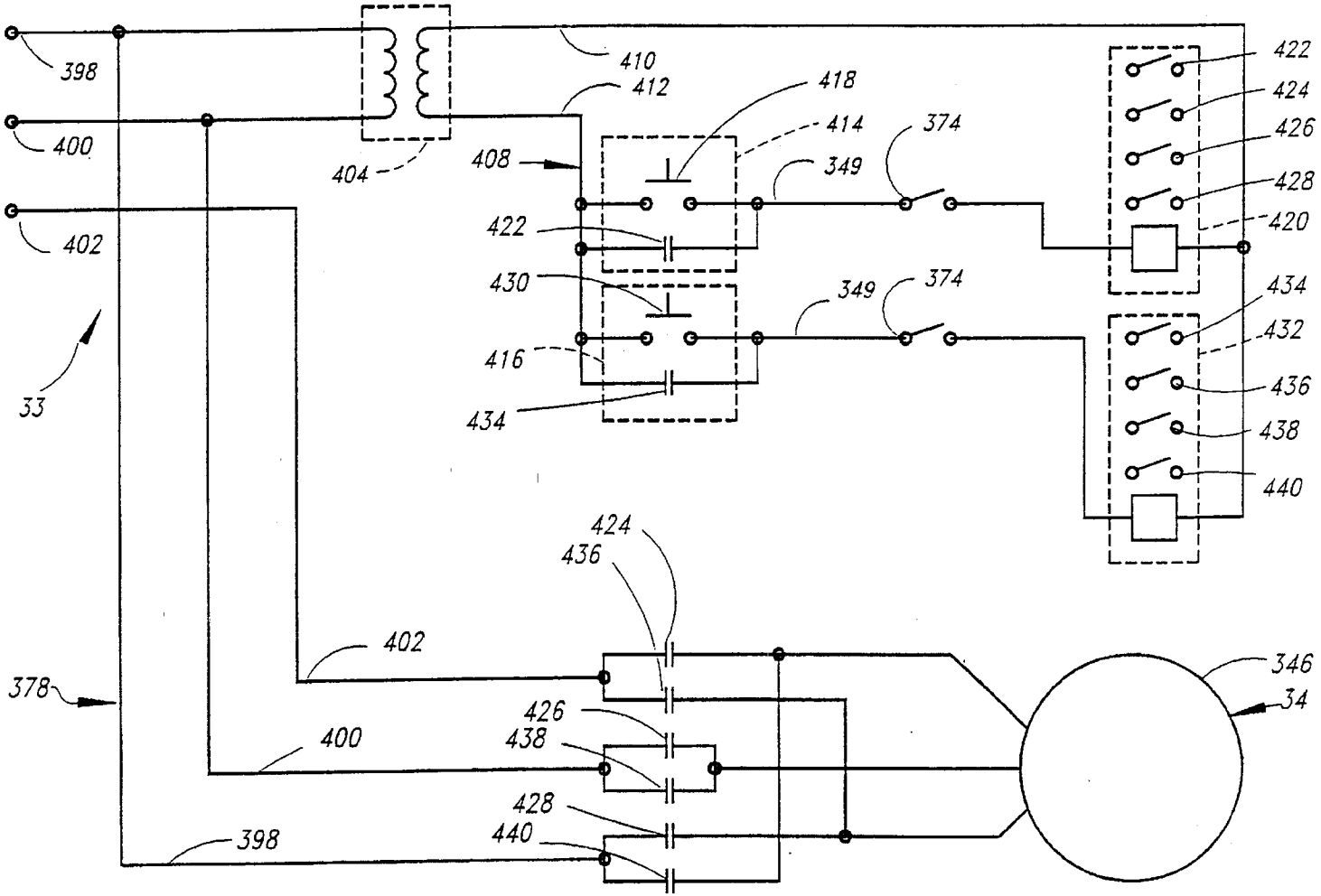
FIG. 13 is a schematic diagram of an elevator door circuit of this invention.

As shown in FIG. 13, the elevator door circuit 378 includes power supply lines 398, 400, 402 to provide a three phase 480 volt power supply in the respective drive operator assembly 34 to the drive motor member 346. The power supply lines 398, 400, 402 are connected to a transformer member 404 to supply single phase 110 volt power to a door control circuit 408.

The power supply lines 398, 400, 402 are directed through relay contact levers to the drive motor member 346 as will be explained.

The door control circuit 408 includes door control lines 410, 412 having a door control line 412 connected to one side of an open switch assembly 414 and a close switch assembly 416. The open switch member 414 includes an open button 418 connected through the electrical contact member 374 to an open motor starter relay 420. The open motor starter relay 420 is provided with open contact levers 422, 424, 426, 428.

The close switch assembly 416 includes a close button 430 operable to energize a close motor starter relay 432. The close motor starter relay 432 includes close contact levers 434, 436, 438, 440.

Energization of the open motor starter relay 420 would close the open contact levers 422, 424, 426, and 428 which will energize the drive motor member 346 and by-pass the open button 418 due to the open contact lever 422. The contact points 337 in the electrical contact member 374 will open and de-energize the drive motor member 346 after the bi-parting door assembly 30 has been opened.

Energization of the close motor starter relay 432 would close the close contact levers 434, 436, and 440 which will energize the drive motor member 346 and by-pass the close button 430 due to the close contact lever 434. The contact points 337 in the electrical contact member 374 will open and de-energize the rotating drive motor member 346 (arrow 414) after the bi-parting door assembly 30 has been closed.

USE AND OPERATION OF THE INVENTION

In the use and operation of the bi-parting elevator door actuator apparatus 12, new and novel features lie primarily in 1) the door interlock and power control assembly 32; 2) the plurality of roller and roller adjustment assemblies 150 mounted on the upper and lower panel assemblies 40, 42 of the bi-parting door assembly 30; and 3) the bi-fold door actuator assembly 31 having a door operator assembly 34 mounted on each opposed vertical side of the hi-parting door assembly 30.

The door interlock and power control assembly 32 is illustrated in FIG. 1 being positioned adjacent the trucking bar member 60 of the lower panel assembly 42 and secured to an adjacent stationary support wall section 20.

In the closed position of the hi-parting door assembly 30 as noted in FIG. 1, refer to FIG. 3 which will illustrate the condition of the door interlock and power control assembly 32.

More particularly, in this condition, the cam roller and linkage assembly 142 has the roller arm member 158 with attached roller member 196 in an outwardly extended position. In this position, it is noted that the door bolt member 216 has been biased outwardly by the return spring member 218 with a trucking bar contact surface 234 of the door bolt member 216 abutting an undersurface of the trucking bar member 60. This, then, prevents the bi-parting door assembly 30 from inadvertently being opened and provides a mechanical locking feature.

At this time of the outwardly extended position of the roller arm member 158, it is to be noted that the electrical contacts within the first power relay assembly 154 have been closed to allow current flow therethrough as noted in FIG. 6.

As shown in FIG. 3, the door trip arm member 274 of the door trip arm assembly 270 is engaged with an inner surface of the trucking bar 60 which concurrently is operable to rotate the first pivot bolt member 156 and the pivot contact member 320 of the second power relay assembly 282. This moves the contact arm member 328 to a closed position providing electrical power therethrough as noted in FIG. 6.

This mechanical condition is illustrated in FIG. 14 and, as shown in FIG. 12, electrical power is supplied through both the first power relay assembly 154 and the second power relay assembly 282 being connected in a series and provides a source of electrical power to the elevator drive motor 388 to allow the elevator car assembly 14 to move between floors.

Upon reaching a selected floor, the elevator operator would energize the retiring cam motor 391 through the retiring cam relay 390 so that the retiring cam member 146, on the moving elevator car assembly 14, would move inwardly as shown by an arrow 400 in FIG. 4 and arrow 418 in FIG. 15 to cause 1) the roller and roller adjustment assembly 150 to move inwardly as noted by an arrow 417 in FIG. 15; 2) the door bolt member 216 to be retracted as noted by an arrow 403; and 3) the first pivot bolt member 156 and the contact arm member 244 in the first power relay assembly 154 will rotate as noted by an arrow 420 in FIG. 15 which would cause the electrical contacts therein to open which would de-energize any power to the elevator drive motor 388.

Figure 8:
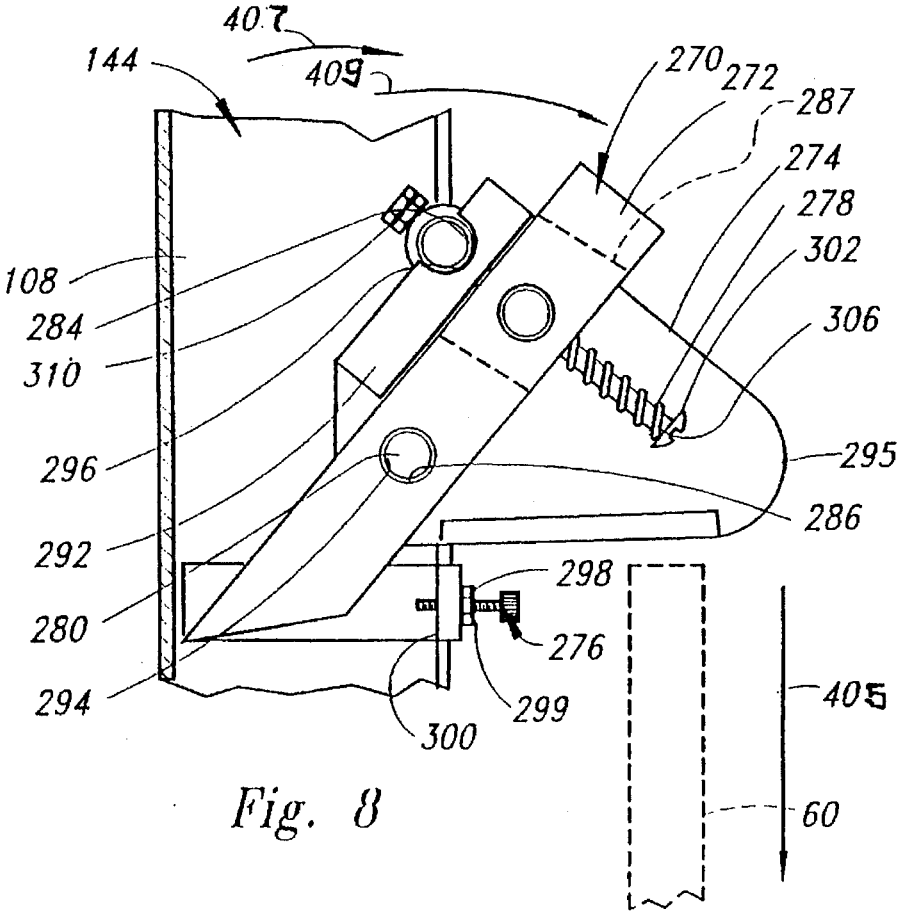
FIG. 8 is a view similar to FIG. 7 illustrating movement of a door actuated power assembly on releasing contact with a portion of a bi-parting door assembly.

Since the bi-parting door assembly 30 has been unlatched, the lower panel assembly 42 with its attached trucking bar member 60 can proceed to be lowered as noted by an arrow 405 in FIG. 8. On the lower panel assembly 42 being lowered, the door trip arm member 274 pivots outwardly as noted by an arrow 409 in FIG. 8.

This pivotal movement of the door trip arm member 274 is caused by the return spring member 242 in the second power relay assembly 282. This causes movement of the relay actuator arm member 272 due to the force of the compression spring member 306 to cause rotation of the second pivot bolt member 280. This opens the pivot contact members 236 of the second power relay assembly 282. The normally closed contact arm member 244 rotates to the open position as noted in FIG. 16 which is connected in series to the open first power relay assembly 154. This provides an additional safety feature to assure that the elevator drive motor 388 cannot be energized when the bi-parting door assembly 30 is being moved to the open position as noted by the arrow 405 in FIG. 16.

Further, it is noted that the first power relay assembly 154 and the second power relay assembly 282 are mounted within the explosion proof housing and cover assembly 100 to provide a safety feature in grain elevators and the like where dust particles are present or other explosive conditions exist.

After loading or unloading the elevator car assembly 14, the bi-parting door assembly 30 is moved to the closed position to contact the door trip arm member 274. This closes the electrical contacts within the first power relay assembly 154 to allow selective energization of the elevator drive motor 388 on closure of the electrical contacts with the second power relay assembly 282.

Concurrently, with outer pivotal movement of the roller and roller adjustment member 150, the door bolt member 216 moves to the latched position as shown in FIG. 3.

Next, on depressing the up button 405 or the down button 421 as shown in FIG. 12, the retiring cam relay 390 energizes the retiring cam motor 391 to retract the retiring cam member 146. The roller and roller adjustment member 150 moves outwardly under force of the return spring member 242 in the first power relay assembly 154 to the position shown in FIGS. 6 and 14.

With the door interlock and power control assembly 32 in the position of FIGS. 3 and 14, movement of the elevator car assembly 14 can be achieved through the elevator drive and control circuit 376 and the elevator control circuit 380 on actuation of the up button 405 or the down button 421 as shown in FIG. 12.

Another novel feature of the bi-parting elevator door actuator apparatus 12 is illustrated in FIG. 2 with the guide and roller assembly 43 with the roller members 96. Each roller member 96 has a track receive slot 98 about its outer periphery. The track receiver slot 98 receives a portion of a stationary guide track member 76 therein to assure easy opening and closing of the bi-parting door assembly 30.

Each roller member 96 is adjustable to assure desired contact of the guide track member 76 with the track receiver slot 98.

As noted in FIG. 9 and by an arrow 410 see FIG. 9, mechanical driving power is supplied from the drive motor member 346 through the power transfer assembly 348, the actuator clutch assembly 366, and to the door actuator assembly 352. Concurrently, mechanical driving power is supplied from the main power drive assembly 342 to a cycle reset assembly 344. In this normal power drive, the mechanical driving power is supplied to the door actuator assembly 352 to raise and lower the upper panel assembly 40 and the lower panel assembly 42.

On having an obstruction between the upper panel assembly 40 and the lower panel assembly 42 during closing thereof, mechanical driving power is eliminated to the door actuator assembly 352 as shown by an arrow must be shown in FIG. 10. In this case, power is only supplied to the cycle reset assembly 344 as the obstruction would cause the friction clutch plates 355 to slip relative to each other.

When this happens, the adjustable cam switch arm 368 would continue to rotate until it contacts the electrical contact member 374 to then de-energize power to the drive motor member 346.

After an obstruction is removed between the upper and lower panel assemblies 40, 42, energization of the drive motor member 346 would cause the cycle transfer assembly 345 and attached cycle reset assembly 344 to rotate through a complete cycle until the electrical contact member 374 is engaged. If the upper panel assembly 40 and lower panel assembly 42 are in an abutting condition, this will react similar to an obstruction being mounted therein and the cycle reset assembly 344 will rotate a a complete cycle to automatically reset itself for operation.

A schematic illustration is shown in FIG. 17 which clearly describes the functional and interacting steps during operation of the bi-parting elevator door actuator apparatus 12 of this invention.

In the first step, 1) the elevator car assembly 14 is operational and the bi-parting door assembly 30 has been closed and the door interlock and power control assembly 32 engaged; and 2) the first and second power relay assemblies 154, 282 are closed and power is available to the elevator drive motor 388.

In a second step, the elevator car assembly 14 reaches selected floor and stops.

In a third step, the elevator car assembly 14 stops when the retiring cam member 146 engages the cam roller and linkage assembly 142 to open the first power relay assembly 154. The door bolt member 216 retracts from a trucking bar member 60 so that the bi-parting door assembly 30 can be opened.

In a fourth step, the operator opens the bi-parting door assembly 30 of the elevator car assembly 14 and the door trip arm assembly 270 pivots outwardly. On pivotal movement of the door trip arm assembly 270, the second power relay assembly 282 opens further denying electrical power to the elevator drive motor 388.

In a fifth step, the elevator car assembly 14 with the open bi-parting door assembly 30 can be loaded or unloaded.

In a sixth step, the operator closes the bi-parting door assembly 30 of the elevator car assembly 14 and the second power relay assembly 282 closes.

In a final seventh step, the retiring cam member 146 retracts and disengages from the roller member 96 and moves outwardly. This causes the first power relay assembly 154 to close and electrical power is available to allow energization of the elevator drive motor 388. Concurrently, the door bolt member 216 is extended and engages the trucking bar member 60 to lock the bi-parting door assembly 30 in the closed position.

While the invention has been described in conjunction with preferred specific embodiments thereof, it will be understood that this description is intended to illustrate and not to limit the scope of the invention, which is defined by the following claims:

I claim:

1. A bi-parting elevator door actuator apparatus operable with an elevator car assembly, comprising:

a) a bi-parting door assembly having an upper panel assembly and a lower panel assembly movable vertically from closed to opened positions and visa versa;

b) a door interlock and power control assembly including a cam actuated interlock and power assembly having a cam roller and linkage assembly, a door latch assembly, and a power relay assembly operably connected to an elevator drive motor;

c) said door latch assembly engagable with said bi-parting door assembly when closed to prevent opening thereof;

d) said cam roller and linkage assembly connected to said power relay assembly operable to close said power relay assembly between floors and open said power relay assembly at a floor where the elevator car assembly is to be stopped to prevent movement of the elevator car assembly;

e) said cam roller and linkage assembly connected to said door latch assembly operable to disengage same with said bi-parting door assembly when at the floor where the elevator car assembly is to be stopped;

f) said door interlock and power control assembly includes a door actuated power assembly having a door trip arm assembly connected to a second power relay assembly;

g) said door trip arm assembly engagable with said bi-parting door assembly when in the closed position to close said second power relay assembly to permit movement of the elevator car assembly; and h) when said bi-parting door assembly is in the opened position, said door trip arm assembly operates to open said second power relay assembly to prevent movement of the elevator car assembly.

2. A bi-parting elevator door actuator apparatus as described in claim 1, wherein:

a) said door trip arm assembly being adjustable to regulate the force against said bi-parting door assembly to assure movement of said second power relay assembly from opened to closed positions.

3. A bi-parting elevator door actuator apparatus as described in claim 1, wherein:

a) said door interlock and power control assembly includes an explosion proof housing and cover assembly having said power relay assembly mounted therein; and b) said explosion proof housing and cover assembly presents an air-tight condition therein to prevent an explosion on actuation of said power relay assembly.

4. A bi-parting elevator door actuator apparatus as described in claim 1, wherein:

a) said door operator assembly includes a cycle reset assembly connected to said power drive assembly; and b) said cycle reset assembly operable on reaching either the opened or closed positions to cease power to said main power drive assembly and prevent movement of said upper panel assembly and said lower panel assembly.

5. A bi-parting elevator door actuator apparatus operable with a bi-parting door assembly, comprising:

a) a bi-parting door assembly having a first panel assembly and a second panel assembly movable from closed to opened positions and visa versa;

b) a bi-fold door actuator assembly having a door actuator assembly connected to and operable to move said first panel assembly and said second panel assembly from the closed to the opened positions;

c) said door actuator assembly includes a main power drive assembly connected to said first panel assembly and said second panel assembly to move said first and second panel assemblies from the closed to the opened positions and visa versa, and an actuator clutch assembly connected to said main power drive assembly;

d) said actuator clutch assembly operable to disengage when an object is placed between said first panel assembly and said second panel assembly on closing thereof to prevent damage to said first and second panel assemblies and said main power drive assembly;

e) said door actuator assembly includes a cycle reset assembly connected to said main power drive assembly;

f) said cycle reset assembly includes a switch actuator assembly having a cam switch arm periodically engagable with an electrical contact member;

g) said cam switch arm operably connected to said main power drive assembly so as to be rotatable therewith; and h) said cycle reset assembly connected to said actuator clutch assembly and continuously rotatable with said main power drive assembly, and said cam switch arm operable on slippage of said actuator clutch assembly to continue rotation to actuate said electrical contact member to cease power to said main power drive assembly on reaching the closed or opened positions of the bi-parting door assembly.

6. A bi-parting elevator door actuator apparatus as described in claim 5, including:

a) a door interlock and: power control assembly having a cam actuator interlock and power assembly;

b) said door interlock and power control assembly includes an explosion proof housing and cover assembly having said first power relay assembly mounted therein to achieve an explosion proof atmosphere therein.

7. A bi-parting elevator door actuator apparatus as described in claim 5, including:

a) a door interlock and power control assembly having a cam actuator interlock and power assembly;

b) said door interlock and power control assembly includes a door actuated power assembly;

c) said door actuated power assembly includes a door trip arm assembly operably connected to a second power relay assembly; and d) said door trip arm assembly includes a door lock member engagable with said bi-parting door assembly to hold in a locked position when said bi-parting door assembly is in the closed position.

8. A bi-parting elevator door actuator assembly as described in claim 7, wherein:

a) said door trip arm assembly is moved to a released position when said bi-parting door assembly is in the opened position and said second power relay assembly is moved to an opened position to prevent movement of the elevator car assembly when said bi-parting door assembly is in the opened position.

9. A bi-parting elevator door actuator apparatus, comprising:

a) a bi-parting door assembly having a first door member and a second door member movable relative to each other from opened to closed positions and vice versa to reveal an elevator car assembly;

b) a guide and roller assembly connected to a movable portion of said bi-parting door assembly;

c) said guide and roller assembly having a roller assembly connected to said movable portion of said bi-parting door assembly and engagable with a stationary portion of said bi-parting door assembly;

d) said roller assembly having a roller member with a circumferential slot receiving said stationary portion therein to control movement of said first and second door members in two aligned directions;

e) said roller member connected to a roller support member; and f) said roller support member is rotatable to increase or decrease a distance between said circumferential slot and said stationary portion to adjustably control movement of said bi-parting door assembly.

10. A bi-parting elevator door actuator apparatus as described in claim 9, wherein:

a) a door interlock and power control assembly engagable with said bi-parting door assembly;

b) said door interlock and power control assembly includes a cam actuated interlock and power assembly, c) said cam actuated interlock and power assembly includes a cam roller and linkage assembly, a door latch assembly, and a first power relay assembly; and d) said cam roller and linkage assembly movable to an extended position when not engaged with a portion of the elevator car assembly, and operable to move said door latch assembly to a locked position engaged with a portion of said bi-parting door assembly when engaged with a portion of the elevator car assembly with said first power relay assembly moved to a closed position to allow power movement of the elevator car assembly.

11. A bi-parting elevator door actuator apparatus operable with an elevator car assembly, comprising:

a) a bi-parting door assembly movable from closed to opened positions and visa versa;

b) a door interlock and power control assembly including a cam roller and linkage assembly, a door latch assembly, and a power relay assembly operably connected to an elevator drive motor;

c) said door latch assembly engagable with said bi-parting door assembly when closed to prevent opening thereof;

d) said cam roller and linkage assembly connected to said power relay assembly operable to close said power relay assembly between floors and open said power relay assembly at a floor where the elevator car assembly is to be stopped to prevent movement of the elevator car assembly;

e) said cam roller and linkage assembly connected to said door latch assembly operable to disengage same with said bi-parting door assembly when at the floor where the elevator car assembly is to be stopped;

f) said door interlock and power control assembly includes a door actuated power assembly having a door trip arm assembly connected to a second power relay assembly; and g) said door trip arm assembly engagable with said bi-parting door assembly when in the closed position to close said second power relay assembly to permit movement of the elevator car assembly.

12. A bi-parting elevator door actuator apparatus as described in claim 11, wherein:

a) said door trip arm assembly being adjustable to regulate the force against said bi-parting door assembly to assure movement of said second power relay assembly from opened to closed positions.

13. A bi-parting elevator door actuator apparatus as described in claim 11, wherein:

a) a door actuator assembly connected to said bi-parting elevator door for power movement from the closed to the opened positions and visa versa;

b) said door actuator assembly includes a main power drive assembly connected to a door actuator assembly which, in turn, is connected to said bi-parting door assembly for movement from the closed to the opened positions and visa versa;

c) said door actuator assembly includes an actuator clutch assembly connected to said main power drive assembly;

d) said actuator clutch assembly operable to disengage when an object is positioned within said bi-parting door assembly when being moved from the opened position to the closed position to prevent damage to said main power drive assembly and said bi-parting door assembly; and e) said actuator clutch assembly operable to recycle when the object is removed from within said bi-parting door assembly.

14. A bi-parting elevator door actuator apparatus as described in claim 11, wherein:

a) said door interlock and power control assembly includes an explosion proof housing; and b) said explosion proof housing and cover presents an air-tight condition therein to prevent an explosion on actuation of said power relay assembly.

15. A bi-parting elevator door actuator apparatus as described in claim 13, wherein:

a) said door actuator assembly includes a cycle reset assembly connected to said power drive assembly; and b) said cycle reset assembly operable on reaching either the opened or closed positions to cease power to said main power drive assembly and prevent movement of said upper panel assembly and said lower panel assembly.

16. A bi-parting elevator door actuator apparatus operable with a bi-parting door assembly, comprising:

a) a bi-parting door assembly having a first panel assembly and a second panel assembly movable from closed to opened positions and visa versa;

b) a bi-fold door actuator assembly having a door actuator assembly connected to and operable to move said first panel assembly and said second panel assembly from the closed to the opened positions;

c) said door actuator assembly includes a main power drive assembly connected to said first panel assembly and said second panel assembly to move said first and second panel assemblies from the closed to the opened positions and visa versa, and an actuator clutch assembly connected to said main power drive assembly;

d) said actuator clutch assembly operable to disengage when an object is placed between said first panel assembly and said second panel assembly on closing thereof to prevent damage to said first panel assembly, said second panel assembly, and said main power drive assembly;

e) said door actuator assembly includes a cycle reset assembly connected to said main power drive assembly;

f) said cycle reset assembly includes a switch actuator assembly having a cam switch arm periodically engagable with an electrical contact member;

g) said cam switch arm operably connected to said main power drive assembly so as to be rotatable therewith;

h) said cycle reset assembly connected to said actuator clutch assembly and continuously rotatable with said main power drive assembly, and said cam switch arm operable on slippage of said actuator clutch assembly to continue rotation to actuate said electrical contact member to cease power to said main power drive assembly on reaching the closed or opened positions of said bi-parting door assembly; and i) said cycle reset assembly automatically operable on removing an obstruction between said bi-parting door assembly to complete a cycle and reset itself.

17. A bi-parting elevator door actuator apparatus operable with a bi-parting door assembly, comprising:

a) a bi-parting door assembly movable from closed to opened positions and visa versa;

b) a bi-fold door actuator assembly having a door actuator assembly connected to and operable to move said bi-parting door assembly from the closed to the opened positions;

c) said door actuator assembly includes a main power drive assembly to move said bi-parting door assembly from the closed to the opened positions and visa versa, and an actuator clutch assembly connected to said main power drive assembly;

d) said actuator clutch assembly operable to disengage when an object is placed within said bi-parting door assembly on closing thereof to prevent damage to said main power drive assembly;

e) said door actuator assembly includes a cycle reset assembly connected to said main power drive assembly;

f) said cycle reset assembly connected to said actuator clutch assembly and rotatable with said main power drive assembly, and operable on slippage of said actuator clutch assembly to continue rotation to cease power to said main power drive assembly on reaching the closed or opened positions of said hi-parting door assembly;

g) said cycle reset assembly automatically operable on removing an obstruction between said hi-parting door assembly to complete a cycle and reset itself;

h) said main power drive assembly includes a door trip arm assembly operably connected to a second power relay assembly;

i) said door trip arm assembly engagable with said bi-parting door assembly to hold in a locked position when said bi-parting door assembly is in the closed position; and j) said second power relay assembly is held in a closed position.

18. A bi-parting elevator door actuator apparatus as described in claim 17, wherein:

a) said door trip arm assembly is moved to a released position when said bi-parting door assembly is in the opened position and said second power relay assembly is moved to an opened position to prevent movement of the elevator car assembly when said bi-parting door assembly is in the opened position.

19. A bi-parting elevator door actuator apparatus as described in claim 16, including:

a) a guide and roller assembly having a roller assembly connected to a movable portion of said bi-parting door assembly and engagable with a stationary portion of said bi-parting door assembly;

b) said roller assembly having a roller member with a circumferential slot connected to a roller support member; and c) said roller support member is rotatable to increase or decrease a distance between said circumferential slot and said stationary portion to adjustably control movement of said bi-parting door assembly.

20. A bi-parting elevator door actuator apparatus as described in claim 11, wherein:

a) said door operator assembly includes a cycle reset assembly connected to said power drive assembly automatically operable to cease power to said main power drive assembly in the opened or closed positions; and b) said cycle reset assembly automatically resets itself on removing an obstruction between said bi-parting door assembly.

* * * * *